US006040558A

United States Patent [19]

Yamazaki

[11] Patent Number: 6,040,558

[45] Date of Patent: Mar. 21, 2000

[54] IMAGE HEATING APPARATUS

[75] Inventor: Michihito Yamazaki, Tokyo, Japan

[73] Assignee: Canon Kabushiki Kaisha, Tokyo, Japan

[21] Appl. No.: 09/071,160

[22] Filed: May 4, 1998

[30] Foreign Application Priority Data

May 14, 1997 [JP] Japan ..... 9-137995

[51] Int. Cl.[7] ..... G03G 15/20

[52] U.S. Cl. ..... 219/216; 399/69; 399/329

[58] Field of Search ..... 219/216, 486, 219/492, 494; 399/67–70, 324, 329, 338

[56] References Cited

U.S. PATENT DOCUMENTS

| | | | |
|---|---|---|---|
| 4,611,902 | 9/1986 | Schon | 219/216 |
| 4,998,121 | 3/1991 | Koh et al. | 219/216 |
| 5,114,337 | 5/1992 | Yamazaki . | |
| 5,376,773 | 12/1994 | Masuda et al. | 219/543 |
| 5,724,628 | 3/1998 | Sano | 219/216 |

FOREIGN PATENT DOCUMENTS

| | | |
|---|---|---|
| 0 006 553 | 1/1980 | European Pat. Off. . |
| 0 362 791 | 4/1990 | European Pat. Off. . |
| 0 797 130 | 9/1997 | European Pat. Off. . |
| 56-168677 | 12/1981 | Japan . |
| 60-050566 | 3/1985 | Japan . |
| 63-313182 | 12/1988 | Japan . |
| 2-157878 | 6/1990 | Japan . |
| 2-271375 | 11/1990 | Japan . |
| 4-220673 | 8/1992 | Japan . |
| 5-70007 | 3/1993 | Japan . |
| 6-161321 | 6/1994 | Japan . |
| 6-202507 | 7/1994 | Japan . |
| 6-236128 | 8/1994 | Japan . |

*Primary Examiner*—Joseph Pelham

*Attorney, Agent, or Firm*—Fitzpatrick, Cella, Harper & Scinto

[57] ABSTRACT

The present invention provides an image heating apparatus comprising a heater, a film sliding, and a back-up member. The heater includes a first heat-generating member for generating heat by electric power supply thereto, and a second heat-generating member, provided at the downstream side of the first heat-generating member with respect to the moving direction of the recording material, for generating heat by electric power supply thereto, and the first and second heat-generating members are so controlled that the ratio of the amounts of heat generation thereof varies depending on the presence or absence of the recording material in the nip.

37 Claims, 5 Drawing Sheets

IMAGE HEATING APPARATUS

BACKGROUND OF THE INVENTION

1. Field of the Invention

The present invention relates to an image heating apparatus adapted for use in an image forming apparatus such as a copying machine or a printer, and more particularly to a device for heating an image with heat transmitted from heater across a film.

2. Related Background Art

In the electrophotographic image forming process, the fixation of the toner image developed on the recording material has generally been achieved by heat and pressure in the heat roller system while the recording material is pinched between and transported by a heating roller controlled at a predetermined temperature and a pressure roller having an elastic layer and maintained in pressurized contact with the heating roller.

Recently, for power saving in the stand-by state and for reducing the time from the start of power supply to the image output, there has been proposed, as disclosed in the Japanese Patent Laid-Open Application Nos. 63-313182 and 2-157878, the fixing device of a film heating fixation method comprising a heater unit including at least a fixed heating member (heater) and a heat-resistant film (fixing film) which is transported in contact with the heater, and a pressing member for maintaining the recording material in close contact with the surface of the heat-resistant film of the heater unit, wherein the toner image formed on the surface of the recording material is fixed by the heat supplied to the recording material from the heater though the film.

FIG. 5 schematically shows an image fixing device, based on the conventional film heating fixation method mentioned above. Referring to FIG. 5, a heater unit 60 is composed of a heat-resistant film 65 of a substantially cylindrical form, a heater 61 constituting the heating member, a film guide 66 provided inside the heat-resistant film 65 and constituting a heater stay for fixing the heater 61, a temperature detecting element 63 maintained in contact with the heater 61 and adapted to detect the temperature thereof, and an inverse U-shaped reinforcing metal plate 67. A pressure roller 77, composed of a metal core 71 and silicone rubber 73 and rendered rotatable, is maintained in pressure contact with the heater unit 60 to constitute the image fixing device. In maintaining the pressure roller 77 in contact with the heater unit 60 under pressure, the reinforcing metal plate 67 provided on the heater stay 66 of the heater unit 60 prevents the heater 61, thermistor 63, heater stay 66 etc. from deformation by the contact force of the pressure roller 77. The temperature detecting element 63 can be composed, for example, of a thermistor.

The heat-resistant film 65 of the substantially cylindrical form is composed of a substrate layer of a polyimide film of a thickness of 40 to 60 $\mu$m, and a releasing layer of a thickness of 5 to 20 $\mu$m, provided on the external peripheral surface (coming into contact with the recording material and the toner image) and consisting of PFA and a dispersion of PTFE in PFA. The heat-resistant film 65 is so constructed as to have an internal peripheral length larger than that of the film guide 66 and the reinforcing metal plate 67, whereby the film guide 66 and the reinforcing metal plate 67 can be positioned inside the heat-resistant film 65.

The heater 61 is composed of an insulating, heat-resistant ceramic substrate of a low heat capacity, elongated in a direction perpendicular to the transport direction of the recording material P, and a heat-generating resistance member 62 printed on the surface of the substrate along the longitudinal direction thereof. The temperature detecting element 63 is maintained in contact with a side of the ceramic substrate, opposite to the exposed surface of the heat-generating resistance member 62. The heater 61 is so fixed, under thermal insulation, to the film guide 66 formed with a semi-circular cross section, as to expose the surface of the heat-generating member. The temperature detecting element 63 maintained in contact with the heater 61 is connected to a CPU 101, which drives a triac 55 according to the temperature detection output of the temperature detecting element 63 to control the current supply from a power source 35 to the heat-generating member 62, thereby controlling the temperature of the heater 61.

The pressure roller 77 is pressed to the heater unit 60 with a total pressure of 9 to 11 kgf by pressurizing means (not shown) and is rotated counterclockwise, along the transporting direction of the recording material P, by drive means (not shown). By the rotation of the pressure roller 77, the heat-resistant film 65 of the heater unit 60 rotates around the film guide 66, while it slides on and in close contact with the surface of the heat-generating member of the heater 61. In order to reduce the sliding friction between the heater and the internal surface of the film, heat-resistant grease is provided therebetween.

In the image fixing device of the above-described configuration, the recording material P is subjected to the fixation, by pressure and fusion, of the toner image supported thereon, while it is guided between the heat-resistant film 65 and the pressure roller 77 by transport means and passed through a fixing nip therebetween while the heater 61 is heated to a predetermined temperature.

The above-described film heating fixation method allows to reduce the heat capacity of the heater to a few per cent of that in the fixing device of the heat roller method, and also to employ a heat-generating member of fast temperature rise, thereby enabling the heater to reach the fixation temperature within a short time in the order of several seconds. It is therefore possible not to effect power supply to the fixing device during the stand-by state but to start the power supply after the recording material is picked up in the course of the image forming operation, thereby saving the power consumption and shortening the start-up time of the equipment.

With such film heating fixation device, however, in case a printing operation is started in a state in which the pressure roller etc. are at the room temperature (printing operation is hereinafter called cold start if the power supply to the heat-generating member is started from a state where the pressure roller is at the room temperature), if a sheet of paper left under a high humidity environment is supplied, the vapor generated from the paper under heating condenses on the surface of the pressure roller, thereby significantly reducing the transporting power thereof and causing slippage between the paper and the pressure roller.

Also in the cold start operation mentioned above, the temperature of the pressure roller is higher in the film fixation method than in the heat roller fixation method, so that the temperature is controlled somewhat higher, than in the heat roller fixation method, for the initial several sheets (until the temperature of the pressure roller is sufficiently elevated) in order to fix the image solely with the heat from the heater unit. For this reason, in the film heating fixation device of a configuration in which the distribution of heat generation of the heater surface substantially coincides with the center of pressurization, the viscosity of the toner becomes lower particularly at the downstream side of the fixing nip, thereby eventually resulting in so-called hot offset phenomenon in which the toner is peeled off from the surface of the recording material. Such phenomenon tends to occur more often in thin paper or in high-grade paper.

Also in case a line image is formed on the moist recording material, such image may scatter by the vapor generated at the image fixation and deposit on the recording material, thus smearing the obtained copy. Such scattering phenomenon usually occurs in the downstream side of the image and is therefore called trailing edge.

SUMMARY OF THE INVENTION

An object of the present invention is to provide an image heating apparatus capable of preventing slippage of the recording material and also preventing peeling of the toner from the surface of the recording material.

Another object of the present invention is to provide an image heating apparatus capable of preventing slippage of the recording material and also preventing scattering of the image on the recording material.

Still another object of the present invention is to provide an image heating apparatus in which the heater comprises a first heat generating member and a second heat generating member positioned at the downstream side of the first heat generating member with respect to the moving direction of the recording material, wherein the ratio of the amounts of heat generated by the first and second heat generating members is made different depending on whether the recording material is present in a nip formed between the heater and a back-up member across a film.

Still another object of the present invention is to provide an image heating apparatus comprising detection means for detecting the slippage of the recording material, and controlling the power supply to the heater based on the result of detection by the detection means.

Still other objects of the present invention, and the features thereof, will become fully apparent from the following description.

DETAILED DESCRIPTION OF THE PREFERRED EMBODIMENTS

Now the present invention will be clarified in detail by embodiments thereof, with reference to the attached drawings.

At first an embodiment of the present invention will be explained with reference to FIGS. 1A, 1B, 2, 3 and 4.

Figure 1A:
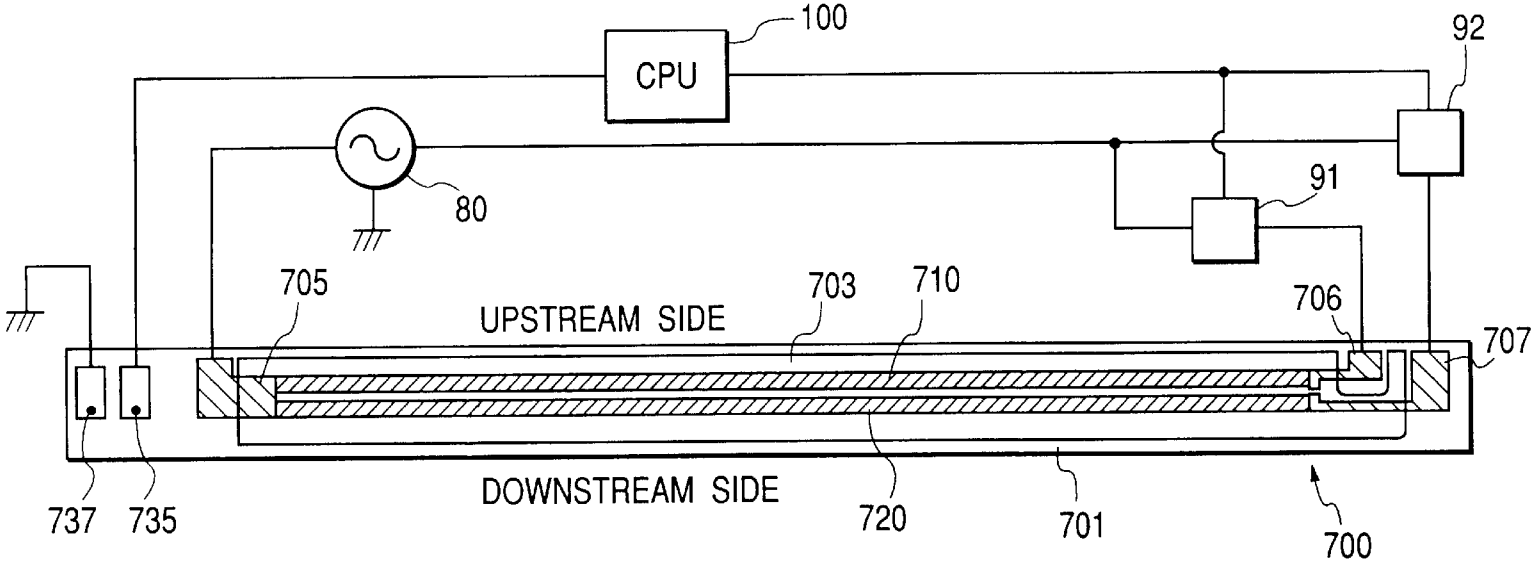
FIG. 1A is a view of a heater and power supply control means to be applied to the image heating apparatus embodying the present invention.
Figure 1B:
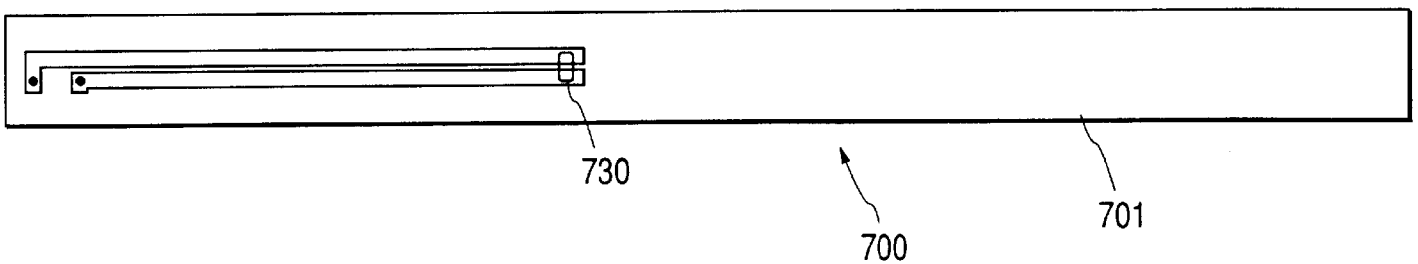
FIG. 1B is a view of the rear side of the heater.

FIGS. 1A and 1B are schematic views showing the principal parts of a heat generating member and power supply control means to be employed in a film heating image fixation device embodying the present invention.

As shown in FIGS. 1A and 1B, a heater 700 constituting the heat generating member is provided with a heat substrate 701, composed for example of alumina and having a substantially rectangular cross section, and such substrate 701 is so positioned that the longitudinal direction thereof is perpendicular to the transporting direction of the recording material and is provided thereon, along the longitudinal direction thereof, with two heat-generating resistance members 710, 720 composed for example of a silver alloy. Power supply control means, for controlling the power supply to the two heat-generating resistance members 710, 720 constituting the heat sources of the heater 700, is constituted by a control circuit composed of a CPU 100, two triacs 91, 92 etc.

The heat generating resistance member 710 (first heat generating member) on the heat substrate 701 is connected, at an end thereof, to an electrode 705 on the substrate, and, at the other end, to an electrode 706. The electrodes 705, 706 are connected to a power source 80 through the triac 91 which is a component in the power supply control means and constitutes the control circuit together with the CPU 100, and the triac 91 is activated by a drive signal from the CPU 100 to supply a current to the heat-generating resistance member 710, thereby heating the upstream side of the heater 700 with respect to the transporting direction of the recording material.

The heat generating resistance member 720 (second heat generating member), provided on the heat substrate 701 at the downstream side of the heat-generating resistance member 710 with respect to the transporting direction of the recording member, is connected, at an end thereof, to the electrode 705 to which an end of the heat-generating resistance member 710 is connected, and, at the other end, to an electrode 707. The electrode 707 is connected to the power source 80 through the triac 92 which is a component in the power supply control means and constitutes the control circuit together with the CPU 100, and the triac 92 is activated by a drive signal from the CPU 100 to supply a current to the heat-generating resistance member 720, thereby heating the downstream side of the heater 700 with respect to the transporting direction of the recording material. Thus the heat-generating resistance members 710, 720 are connected in parallel to the power source 80, and can be operated independently by the control circuit constituted by the two triacs 91, 92 and the CPU 100.

On the two heat-generating resistance members 710, 720 there is provided a glass coating of a thickness for example of 60 $\mu$m in order to ensure insulation and slidability between the heat generating members and a fixing film to be explained later.

On a face of the heater substrate 701 opposite to the heat-generating resistance members, there is provided a thermistor 730 constituting temperature detecting means. The thermistor 730 is connected, through electrodes 735, 737, to the CPU 100 for driving the triacs. The CPU 100 monitors the resistance of the thermistor 730 with a sampling interval for example not exceeding 5 msec, and sends drive signals to the two triacs 91, 92 according to the change in the sampled value within a predetermined time from a predetermined sampled value, whereby the triacs 91, 92 are activated to effect power supply to the heat-generating resistance members 710, 720.

The signals from the CPU 100 to the triacs 91, 92 are transmitted until the resistance of the thermistor monitored by the CPU 100 reaches a predetermined target value, and the power supply to the heat-generating resistance members 710, 720 is so controlled that the resistance of the thermistor 730 is brought to the predetermined target value.

Figure 2:
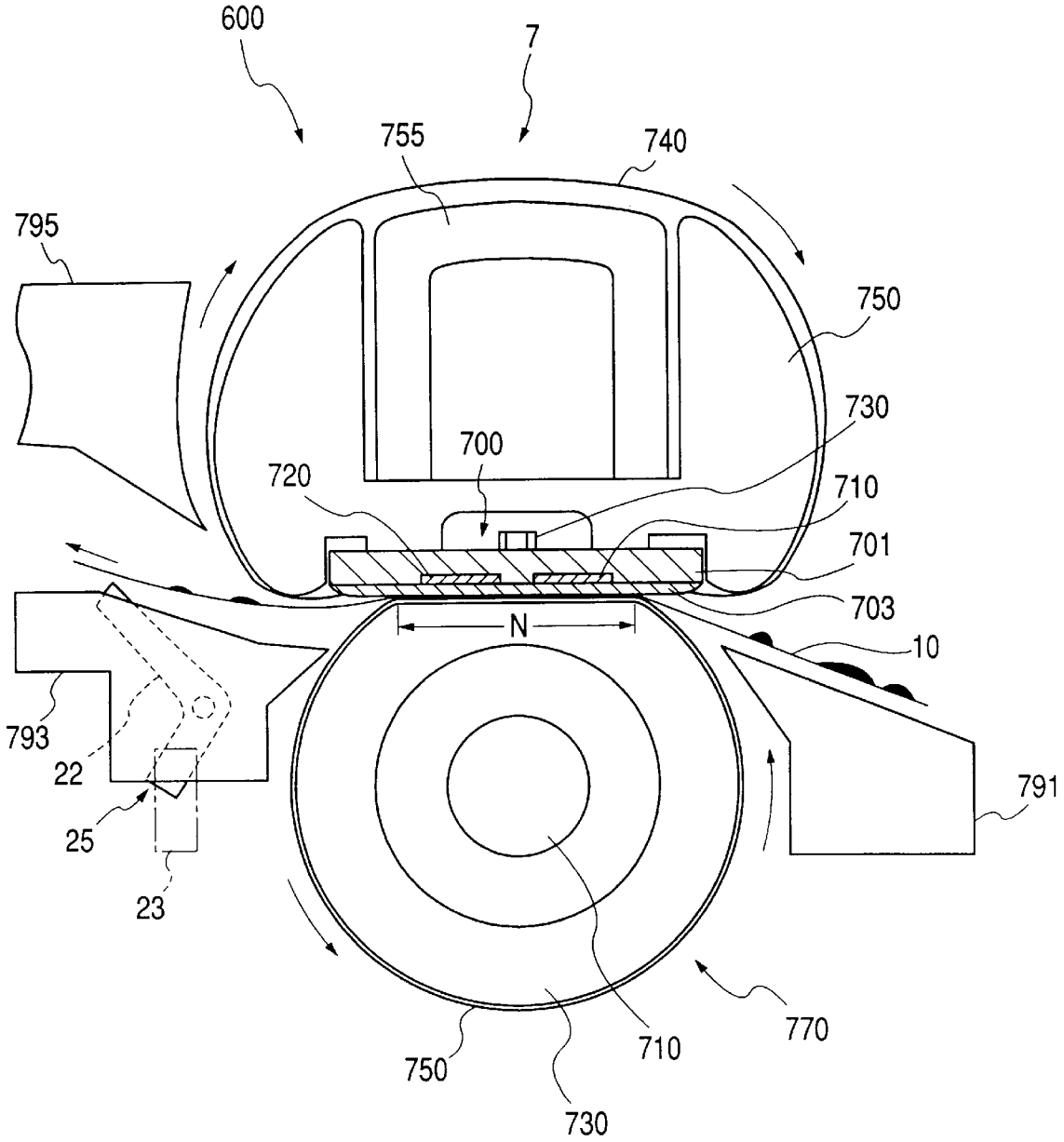
FIG. 2 is a view showing an image heating apparatus embodying the present invention.

FIG. 2 shows an image fixing device of the film heating method embodying the present invention and employing the heater 700 of the above-described configuration. A heater unit 7 employing the heater 700 is composed of a fixing film 740 of a substantially cylindrical form, a heater 700 provided in the internal periphery of the fixing film 740, a fixing film guide 750 composed of heat-resistance resin and serving to guide the fixing film 740 and to support the heater 700, and a reinforcing metal plate 755 for suppressing the bending of the fixing film guide 750. The heat-generating resistance members of the heater 700 are so positioned as to face the internal periphery of the fixing film 740, whereby the surface of the fixing film 740 is heated by the heat generated by the heater 700. The fixing film 740 is composed, for example, of a polyimide film of a thickness of 50 $\mu$m, provided thereon with a conductive layer of a thickness of 5 $\mu$m and a PFA coated layer of a thickness of 10 $\mu$m.

The film 740 is loosely positioned around the heater 700, the film guide 750 and the reinforcing metal plate 755 and is maintained free of tension in at least a part thereof.

A pressure roller 770, constituting pressurizing means or a rotatable back-up member, is pressed to the heater unit 7 and serves to contact a recording material 10, which is guided to a fixing nip N formed between the heater 700 and the pressure roller 770 across the fixing film 740, closely to the heater 700 across the fixing film 740. In thus constructed image fixing device 600, the heat generated by the heat-generating resistance members is given to the recording material 10 to fix the unfixed image thereon by pressurization and fusion. The pressure roller 770 has an external diameter for example of 25 mm and is composed of a metal core 710, a silicone rubber layer 730 of a thickness of 4 mm and a denatured PFA tube 750 of a thickness of 50 $\mu$m. The pressure roller 770 is pressed, by unrepresented pressurizing means, under a total pressure of 14 kgf, toward the heater unit 7 composed of the heater 700, the fixing film 740 and the fixing film guide 750 and is rotated counterclockwise by drive means (not shown) connected thereto. With the rotation of the pressure roller 770, the fixing film 740 pressed thereto is rotated clockwise, sliding over the glass coating 703 provided on the heat-generating resistance members of the heater 700 and transporting the recording material 10 guided to the fixing nip formed between the heater 700 and the pressure roller 770 across the fixing film 740.

An entrance guide member 791 is provided, at the upstream side in the transporting direction of the recording material 10, for assisting the entry of the recording material 10 into the fixing nip, and a lower exit guide member 793 and an upper exit guide member 795 are provided at the downstream side.

In the lower exit guide member 793, there is provided a flapper 22 of a substantially chevron shape, which is rotatably supported at the approximate center thereof. The flapper 22 is so biased, by an unrepresented elastic member such as a spring, that an end protrudes from the recording material transporting face of the lower exit guide member 793, whereby the recording material 10 in passing on the lower exit guide member 793 presses down the end of the flapper 22 and rotates the lower end thereof about the axis thereof. In the vicinity of the lower end of the flapper 22 there is provided a photosensor 23 for detecting the movement of the flapper 22, and these components constitute an end sensor 25 (recording material detecting means) for detecting the front and rear ends of the recording material. Thus the photosensor 23 detects the rotation of the lower end of the flapper 22 to generate a signal indicating the presence/absence of the paper in the sheet discharging portion after the fixing step, thereby achieving sheet jam detection or post-rotation control. The end sensor is not limited to the configuration explained above but can be composed, for example, of a light-emitting element and a photosensor provided in a mutually opposed relationship across the transporting path of the recording material for detecting the passing of the recording material by the presence/absence of the signal from the photosensor, or suitably changed to other known configurations.

Figure 3:
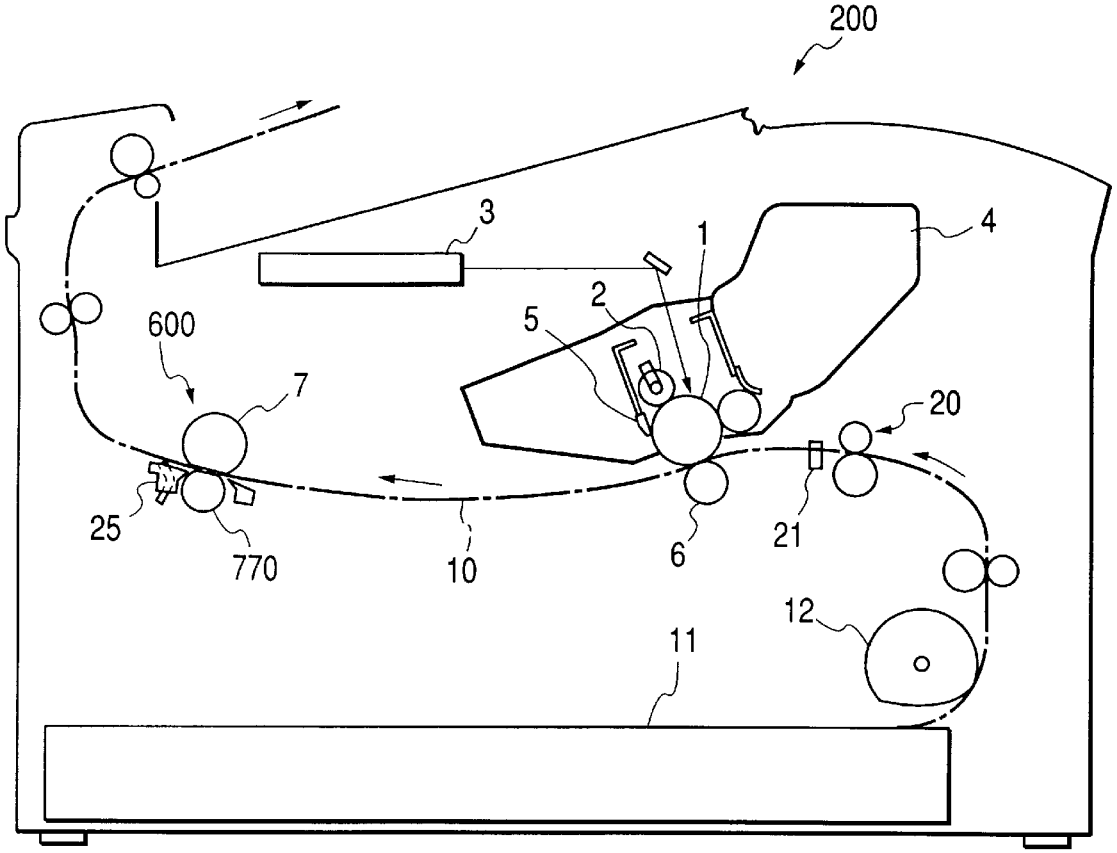
FIG. 3 is a view showing an image forming apparatus employing an image heating apparatus embodying the present invention.

FIG. 3 is a schematic view of an image forming apparatus equipped with the image fixing device 600 employing the heater unit 7 described above. The image forming apparatus 200 is composed, for example, of an organic photosensitive drum 1 constituting an image bearing member for forming an electrostatic latent image thereon, a charging roller 2 constituting a charging member for uniformly charging the surface of the organic photosensitive drum 1, a laser exposure device 3 for effecting imagewise exposure onto the surface of the photosensitive drum 1, a developing device 4 composed for example of a developing sleeve, a developing blade and one-component magnetic toner, for developing the electrostatic latent image on the photosensitive drum 1 into a visible image, a transfer roller 6 constituting transfer means for transferring the visible toner image formed on the photosensitive drum 1 onto a recording material, a cleaning blade 5 for eliminating the toner remaining on the photosensitive drum 1 after the transfer, and an image fixing device 600 composed for example of a heater unit 7 for fixing the toner on the recording material by fusion and a pressure roller 770.

Also at the downstream side of registration roller 20 with respect to the transporting direction of the recording material and in front of the fixing step, there is provided an end sensor 21 constituting detection means for detecting the front and rear ends of the recording material prior to entering the fixing step, and the passing state of the recording material can be detected in combination of another end sensor 25 provided in the discharge unit at the downstream side of the fixing step in the image fixing device 600. The end sensors need not necessarily be provided in the above-mentioned positions but can be provided in any positions in front of and behind the fixing step, or there may be provided three or more send sensors to securely detect the position of the recording materials of various sizes.

The image forming apparatus 200 of the above-described configuration executes image formation by the known electrophotographic process and outputs the formed image by the function of the various units. More specifically, the organic photosensitive drum 1 is uniformly charged by the charging roller 2, and is subjected to imagewise exposure by the laser exposure device 3 to form an electrostatic latent image on the surface of the photosensitive drum 1. The latent image formed on the photosensitive drum 1 is developed by the developing device 4, and the developed image is transferred onto the recording material 10, supplied by a feeding roller 12 from a sheet cassette 11, by the function of the transfer roller 6. The transferred image is heated by the heater unit 7 of the image fixing device 600 and is pressed by the pressure roller 770, thereby being fixed onto the recording material.

In this process, depending on whether the recording material is present or absent (for example during the start-up stage of the heater unit in the pre-rotation step or in the internal between the recording material in the continuous printing operation) in the fixing nip of the image fixing device 600, the power supply to the two heat-generating resistance members 710, 720 is so controlled as to vary the ratio of the power supply duty ratios thereof altering the distribution of heat generation of the heater 700 in the transporting direction of the recording material. The power supply duty ratio means the percentage of power supply, taking the case of full power supply with the same power source as 100%.

More specifically, in case the output of the sheet end sensor 21 indicates the presence of a recording material in the fixing nip, the CPU 100 sends control signals to the triacs 91, 92 so as to increase the power supply duty ratio for the heat-generating resistance member 710 of the upstream side in comparison with that of the heat-generating resistance member 720, thereby effecting power supply principally to the former and increasing the amount of heat generation at the upstream side of the heater 700 in the transporting direction of the recording material.

In more details, in the presence of the recording material in the fixing nip, the heat generation is made larger in the heat-generating resistance member 710 at the upstream side by phase-controlled power supply to the heat-generating resistance member 710 only, in case the temperature control is executed with a total power output within a range of 0 to 50%, with respect to the power obtained by supplying the power source voltage to the two heat-generating resistance members taken as 100%, or, in case the temperature control is executed with a power range exceeding 50%, by driving the heat-generating resistance member 710 with the full power and driving the resistance member 720 under phase control so as to assign a portion of the output exceeding 50%. The phase control means supply of the power source voltage to the heat-generating resistance member in a period from a phase angle corresponding to the power supply duty ratio to the immediately succeeding zero-cross point.

For example, in case the total power output is 30%, the heat-generating resistance member 710 is driven with an output of 60%, while the resistance member 720 is driven with an output of 0%. In case the total power output is 70%, the resistance member 710 is driven with an output of 100%, while the resistance member 720 is driven with an output of 40%. (On the other hand, in case the two heat-generating resistance members are equally driven, for a total power output of 30%, each of the resistance members is driven with an output of 30%, and, for a total power output of 70%, each is driven with an output of 70%.)

On the other hand, in case the recording material is absent in the fixing nip, a phase control A in which the power output is switched in two levels of 0 or 100% and a phase control B in which the power output is switched in eleven levels in steps of 10% from 0 to 100% are alternated in every half cycle of the power source voltage for each heat-generating resistance member, so as to select substantially equal power supply duty ratios for the resistance members 710, 720, thereby obtaining substantially equal amounts of heat therefrom. For example, in a first half-cycle of the power source voltage, the heat-generating resistance member 710 is controlled by the phase control A while the resistance member 720 is controlled by the phase control B, and, the phase controls A and B are interchanged for the resistance members A and B in the next half cycle. Such power supply control provides substantially equal amounts of heat from the heat-generating resistance members 710, 720 in each cycle period of the power source voltage.

Figure 4:
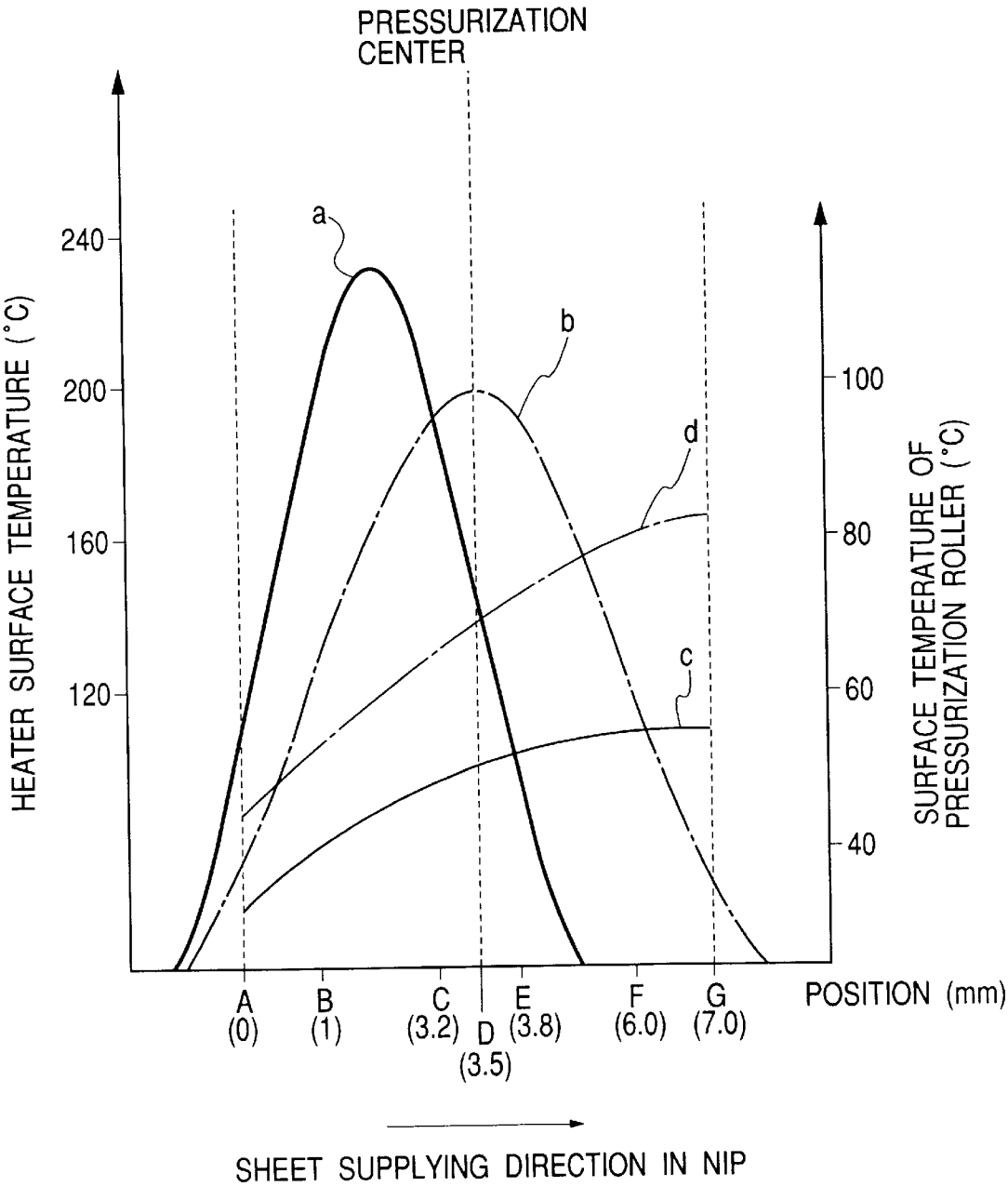
FIG. 4 is a chart showing the distribution of heat generation at the rear face of the heater and the distribution of temperature on the surface of the pressure roller, in the transporting direction of the recording material.
Figure 5:
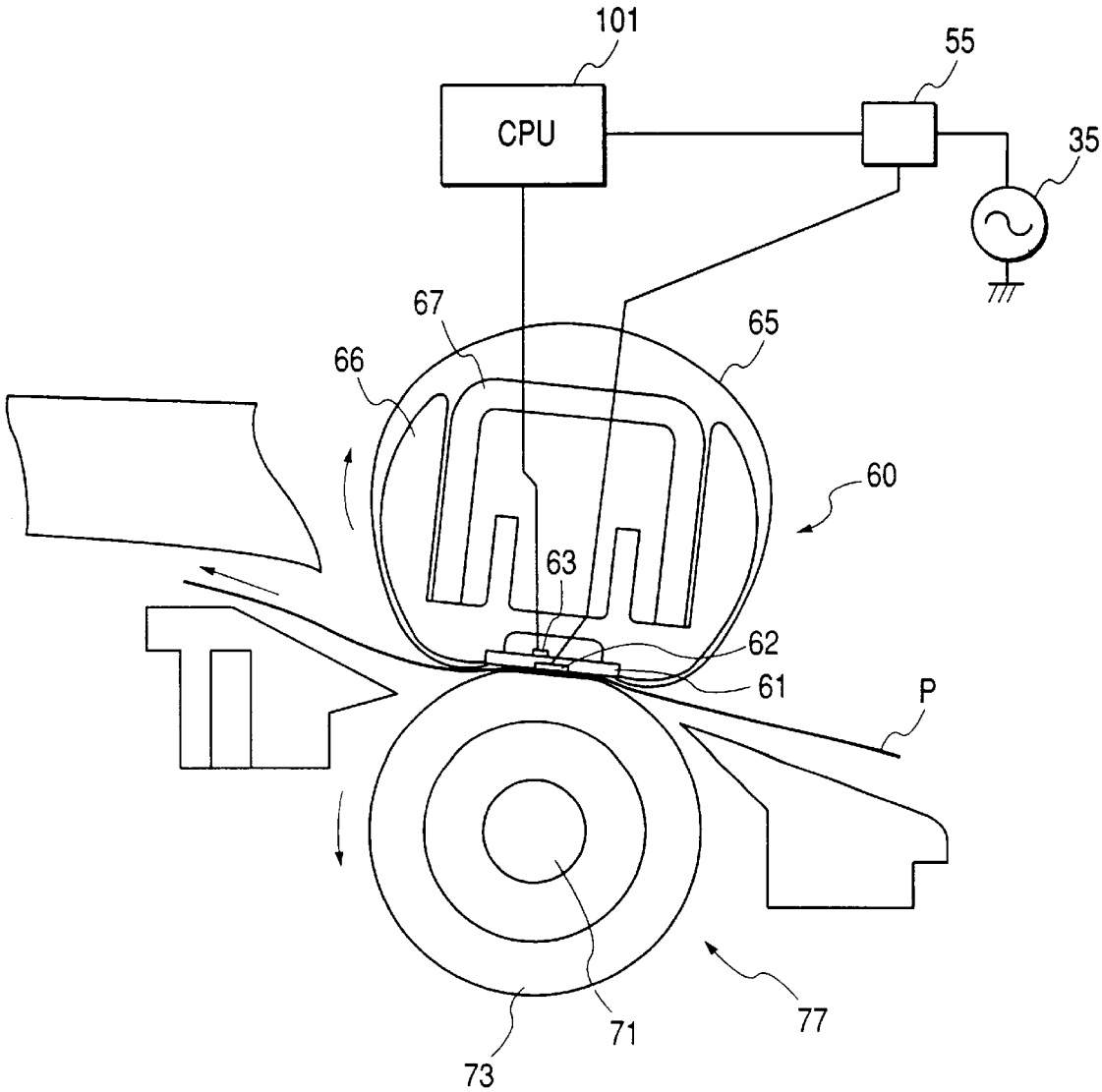
FIG. 5 PRIOR ART
FIG. 5 is a view showing a conventional image heating apparatus.

FIG. 4 is a chart schematically showing the surface temperature of the heater at the heat-generating face thereof in the fixing nip (interaction with the pressure roller being disregarded) and the surface temperature of the pressure roller, when the heater and the pressure roller are heated from the normal temperature state, by the supply of a power of 500 W to the heat-generating members, to 200° C. indicated by the thermistor.

In FIG. 4, the abscissa indicates different positions A to G in the fixing nip, A being the end position of the fixing nip at the upstream side while G being that at the downstream side, D being the center position of pressurization or of the fixing nip N, and the distance from A to G being 7 mm. Also B indicates the end position of the heat-generating resistance member 710 at the upstream side, while C indicates that at the downstream side, and the distance between B and C is 2.2 mm. E indicates the end position of the heat-generating resistance member 720 at the upstream side, while F indicates that at the downstream side, and the distance between E and F is 2.2 mm.

The ordinate indicates the surface temperature of the heater and the pressure roller. A solid-lined curve a indicates the temperature distribution of the heater surface in a state when the temperature detected by the thermistor reaches 200° C. by power supply control only to the heat-generating resistance member 710, and a curve c indicates the surface temperature distribution of the pressure roller in this state. A chain-lined curve b indicates the heater surface temperature in case the two heat-generating resistance members are controlled to generate substantially equal amounts of heat within a cycle time of the power source voltage as explained above, and a curve d indicates the surface temperature distribution of the pressure roller in such state.

Comparison of the power supply control method of obtaining substantially equal amounts of heat from the two heat-generating members within the cycle time of the power source voltage and that of powering the heat-generating resistance member 710 only indicates, in terms of heat transmission to the pressure roller, that the latter control method provides an approximately half heat-generating area and a center of heat generation displaced from the center of pressure, in contrast to the former method. Consequently, in case the heat-generating resistance member 710 alone is powered, the amount of heat transmitted to the pressure roller becomes ½ or less in comparison with the case of generating equal amounts of heat from the two heat-generating members, where the center of heat generation coincides with the center of pressure and the heat-generating area becomes approximately doubled.

Consequently, in elevating the temperature of the heater to the target temperature, the method of powering only the heat-generating resistance member 710 with the center of heat generation shifted to the upstream side allows to achieve such temperature elevation with a lower electric power for a given time or within a short time for a given electric power, in comparison with the method of heat generation of equal amounts, with the center of heat generation at the center of pressure. On the other hand, a faster elevation, to a certain extent, of the surface temperature of the pressure roller can be achieved by generating equal amounts of heat from the two heat-generating resistance members so as to broaden the heat-generating area and to match the center of heat generation with that of pressure.

Also if the above-described two control methods are considered in terms of the heat transmission to the paper constituting the recording material, the surface temperature of the heater is determined by the interaction between the distribution of heat generation of the heat-generating resistance members and the temperature of the pressure roller heated by the heater, so that the highest temperature area on the heater surface is presumed to be shifted, from the center of heat generation, toward the downstream side in the rotating direction of the pressure roller. Consequently, in the heating method in which the center of heat generation substantially matches the center of pressure, the highest temperature area on the heater face is considered to be shifted, from the center of pressure, toward the downstream side in the rotating direction of the pressure roller, but, in case the center of heat generation is at the upstream side of the center of pressure, the highest temperature area of the heater face is presumably closer to the center of pressure.

Now with respect to the method of application of heat and pressure in fixing the toner image to the paper, the efficiency of fixation will be maximized by maximizing the toner temperature at a point where the pressure is highest, and, in the downstream side of the center of pressure within the fixing nip where the pressure gradually decreases, a lower temperature of the heater surface is considered to increase the latitude against the hot offset phenomenon at the sheet separation after the image fixation because the viscosity of the toner becomes higher at the sheet separation from the fixing film 740.

In fact an experiment executed by powering the heat-generating resistance member 710 only in the configuration of the present embodiment confirmed a wider hot offset latitude by 10° C. to 15° C., with scarce loss in the fixing ability, in comparison with the case in which the heat-generating resistance members 710, 720 are powered in parallel with equal amounts of heat generation. Thus, in the comparison of the case where the center of heat generation is at the upstream side of the center of pressure and the case where the center of heat generation is at the center of pressure, the shift of the center of heat generation to the upstream side does not deteriorate the fixing ability if the temperature of the center of pressure remains unchanged, and also reduces the surface temperature of the heater at the downstream side of the center of pressure, thereby expanding the hot offset latitude by 10° C. to 15° C. in the fixing temperature and being thus effective in preventing the hot offset phenomenon in the downstream side in the transporting direction.

Also in the film heating fixation device, the power saving is achieved by suspending the power supply to the heater in the stand-by state and activating the device in the pre-rotation step in the image forming process. Thus, as the temperature of the heater unit is elevated from the room temperature to a fixation temperature around 200° C. within a period of several seconds to about thirty seconds, the surface of the pressure roller is not sufficiently heated, and, if paper containing moisture is passed in such cold start operation, the vapor generated from the paper may be condensed on the surface of the pressure roller, thus significantly reducing the paper transporting ability of the pressure roller and eventually resulting in slippage or the like. Particularly in the fixing device in which the paper and the fixing film are driven by the transporting force of the surface of the pressure roller as in the present embodiment, such slippage increases the paper loop in the path from the image transfer to the image fixation, thus leading to an image smear resulting from the contact of the unfixed image with a member in the image forming apparatus or eventually to paper jamming.

In order to securely prevent the slippage on the pressure roller, the surface temperature of the pressure roller is rapidly raised to prevent the moisture condensation at the activation of the image fixing device, regardless of presence or absence of slippage. More specifically, at the activation of the image fixing device or in the interval of successive recording materials passing through the fixing nip, the heat-generating resistance members 710, 720 are so driven in parallel as to obtain equal amounts of heat therefrom by the control of the power supply duty ratios. It is thus rendered possible to promptly raise the surface temperature of the pressure roller and to prevent the image smear or the sheet jamming which tends to occur in case the paper containing moisture is used in the printing operation immediately after the activation of the device.

As explained in the foregoing, the present embodiment drives the heat-generating resistance members of the upstream and downstream sides of the substantially same duty ratio in the absence of the recording material in the fixing nip, for example at the start-up of the image fixing device or in the interval between the recording materials, but drives the heat-generating resistance members of the upstream and downstream sides at the substantially same duty ratios in the presence of the recording material in the fixing nip, for example at the fixing operation, thereby providing an image forming apparatus capable of achieving a highly efficient fixing operation without unnecessary electric power consumption, providing a wide latitude against the hot offset phenomenon and preventing the image smear or the sheet jamming even in the printing operation with the moisture-containing paper.

In the present embodiment, the method of division of the heat-generating resistance members, the number thereof and the control method therefor are not limited to those described in the foregoing. For example, the heat-generating resistance members 710, 720 need not be of a same resistance, but may have mutually different resistances at the upstream side and at the downstream side, there by varying the ratio of heat generation within the fixing nip. Also in the film heating fixation device of the configuration in which the film is driven by a friction roller, the configuration of the heat-generating members and the control method therefor of the present embodiment may be similarly adopted to increase the latitude against the hot offset phenomenon and to suppress the slippage of the moisture-containing paper in the cold start operation while maintaining satisfactory fixing ability.

In the following there will be explained an embodiment capable of preventing the slippage while suppressing the electric power consumption. The components constituting the device are basically same as those in the foregoing embodiment.

In this embodiment, at the start-up of the fixing device, the power supply is preferentially made to the heat-generating resistance member at the upstream side among the two resistance members basically same as those in the foregoing embodiment, and the slippage of the recording material is detected by the end sensors provided in front of and behind the fixing step, and the power supply to the heat-generating resistance members is controlled according to the result of detection.

More specifically, at the start-up of the image fixing device, the heat-generating resistance member 710 alone is powered by the power supply control means in order to shift the distribution of heat generation of the heater 700 toward the upstream side in the transporting direction. Such shift allows to suppress the heat transmission to the pressure roller, thereby enabling prompt elevation of the temperature of the heater with a lower electric power consumption.

In the start-up stage in such operation, the pressure roller may not be heated sufficiently, so that there may result the aforementioned slippage of the recording material. In order to prevent the slippage resulting from the moisture condensation on the surface of the pressure roller, the end sensor 21 for detecting the recording material in front of the fixing step and the end sensor 25 for detecting the recording material behind the fixing step are connected as shown in FIG. 3 to the CPU 100, constituting the power supply control means, in order to detect the slippage in the recording material and to send detection signal thereto. In case a slippage is identified as present, the power supply control to the two heat-generating resistance members 710, 720 is switched in such a manner as to generate substantially equal amounts of heat in each cycle of the power source voltage, thereby elevating the surface temperature of the pressure roller and suppressing the slippage.

In the image forming apparatus of the present embodiment, the distance from the image transfer to, the image fixation is about 190 mm, while the distance between the points for detecting the leading end of paper by the end sensors 21, 25 is about 250 mm, and the distance between the point for detecting the rear end of paper by the end sensor 21 and the point for detecting the front end of paper by the end sensor 25 is about 240 mm.

The above-mentioned slippage resulting from the moisture condensation on the pressure roller is particularly critical in sheets of a large width and a large length in the transporting direction, such as A3, LDR or LGL size. In the fixation of a paper of a particularly high moisture content, the heat generated by the heater is mostly absorbed by the paper so that the heater is almost heat insulated by the paper. For this reason, the amount of generated vapor increases while the surface temperature of the pressure roller is not yet elevated, so that the amount of slippage increases toward the rear end portion of the paper to induce a delay jamming. Also if the paper length in the transporting direction is shorter than the distance between the image transfer and the image fixation, the image smear resulting from the increase in the paper loop between the image transfer and the image fixation induced by the moisture condensation slippage is not an important problem, but, in case of the paper significantly longer than the above-mentioned distance (A3 or LDR size in the present embodiment), not only the delay jamming but also the image smear become a serious problem.

In the present embodiment, in order to reduce the power supply current at the start-up stage for power saving, the heat-generating resistance member 710 of the upstream side, explained in the foregoing embodiment, is preferentially powered in the start-up stage. Therefore in comparison with the case of generating substantially same amounts of heat from the two heat-generating members, the elevation of the surface temperature of the pressure roller is smaller so that the slippage tends to occur in case of cold start printing operation on the moisture-containing paper.

For this reason, in the present embodiment, in case of continuous printing on the sheets of A3 or LDR size, the time t1 from the detection of the front end of the first sheet by the end sensor 21 to the detection of the front end by the end sensor 25 is compared with the time t2 from the detection of the rear end of the first sheet by the end sensor 21 to the detection of the rear end by the end sensor 25, and, if t2 is equal to or longer than 1.10 times of t1, slippage is judged as present and in response to the result of such comparison, the CPU 100 sends signals to the triacs 91, 92 in order to control the heater 700.

In case the slippage is judged as present, the function of the paper feed/transport means is suspended to interrupt the paper feeding/transporting operation after the discharge of a recording sheet eventually present between the registration rollers 20 and the fixing device, or, if such recording sheet is absent, after the discharge of the recording sheet for which the state $t2 \geqq 1.10 \times t1$ is found. Then, during the period of such suspension of the paper feed/transport operation (for example 20 seconds), the CPU 100 sends drive signals to the triacs 91, 92 so as to generate substantially same amounts of heat from the heat-generating resistance members 710, 720 in each cycle of the power source voltage, thereby elevating the surface temperature of the pressure roller. Such control allows to vaporize the moisture condensed on the pressure roller and to elevated the surface temperature thereof. As a result, the image smear or the paper jamming resulting from the moisture condensation on the surface of the pressure roller no longer occurs until the surface temperature of the pressure roller drops again to about the room temperature. When the slippage is judged as no longer present, the power supply is made preferentially to the heat-generating resistance member 710.

If the printing job is not the continuous printing, the time t1' from the detection of the front end of the recording sheet by the end sensor 21 to the detection of the front end by the end sensor 25 is compared with the time t2' from the detection of the rear end of the recording sheet by the end sensor 21 to the detection of the rear end by the end sensor 25, and, if $t2' \geqq 1.10 \times t1'$, the heat-generating resistance members 710, 720 are so driven as to generate substantially equal amounts of heat therefrom for about 20 seconds in the post-rotation step after the printing operation, thereby elevating the surface temperature of the pressure roller.

The above-described configuration of the image fixing device and the image forming apparatus and the power supply method therefor allow, in the cold start operation with the moisture-containing paper, to heat the pressure roller by the power supply control method of matching the center of heat generation of the heater with the center of pressure, only if the slippage actually occurs between the pressure roller and the paper. As a result, in comparison with the configuration of the foregoing embodiment, there can be provided an image fixing device and an image forming apparatus capable of further suppressing the electric power consumption in the normal state of use.

In the present embodiment, the two heat-generating members are so positioned that the center of heat generation when these members are fully powered coincides with the center of pressure, but the arrangement of the heat-generating members are not limited to such configuration. Even if the center of heat generation when the two heat-generating members are fully powered is shifted toward the upstream or downstream side of the center of pressure, the above-described power supply control method allows to provide an image forming apparatus of a low electric power consumption, without slippage of the moisture-containing paper or hot offset phenomenon.

In the following there will be explained an embodiment capable of preventing the phenomenon of image scattering to the rear by vapor. The components of the apparatus in the present embodiment are basically same as those in the foregoing embodiments.

In the present embodiment in order to reduce the edge trailing phenomenon which is caused, in the formation of a line image on moisture-containing paper, by scattering of the line image by the vapor generated at the image fixation, a trailing edge reducing mode is provided in the CPU of the image forming apparatus, and, in such mode, the power supply is so controlled as to increase the amount of heat generation at the downstream side of the fixing nip and to lower the temperature of the upstream side in the image fixing step.

In the normal operation state, the present embodiment executes, as in the foregoing embodiment, a process of equal heating at the start-up stage and a process of increasing the heat generation at the upstream side in the fixing stage, or a process of increasing the heat generation at the upstream side both in the start-up stage and in the fixing stage. However, if the user judges the presence of trailing edge on the printed image, there is executed the trailing edge reducing mode to increase the amount of heat generation of the heat-generating resistance member 720, thereby reducing the amount of vapor generated at the upstream side of the fixing nip and thus suppressing the edge trailing phenomenon which is caused by the scattering of the unfixed image by the vapor at the upstream side of the fixing nip. The trailing edge reducing mode is executed when a recording material is present in the fixing nip.

In practice, the shift to the trailing edge reducing mode is instructed to the CPU 100 by a predetermined operation, such as the depression of a button by the user, in response to the detection of the trailing edge. After the shift, the CPU 100 transmits drive signals to the triacs 91, 92 so as to increase the amount of heat generated by the heat-generating resistance member 720, thereby lowering the temperature at the upstream side of the fixing nip. In the trailing edge reducing mode, the amount of heat generation of the heat-generating resistance member 720, positioned at the downstream side in the transporting direction of the recording material, is increased, for example in case of a power supply output within a range of 0 to 50%, by phase-controlled power supply to the resistance member 720 of the downstream side only, and, in case of a power supply output exceeding 50%, by fully driving the resistance member 720 and assigning a portion of the output exceeding 50% to the resistance member 710 under phase control.

The trailing edge reducing mode can be suitably terminated by the user. Since the trailing edge phenomenon occurs for example when the recording material contains moisture, it is also possible to detect the slippage of the recording material by the end sensors provided in front of and behind the fixing step as explained in the foregoing embodiment and to return the device from the trailing edge reducing mode to the ordinary printing mode when the slippage becomes no longer detected.

Since the amount of heat generation at the upstream side of the fixing nip is desirably increased in order to effectively apply heat and pressure to the paper and the toner, as explained in the foregoing embodiment, it is preferable, for power saving and for hot offset prevention in the ordinary paper, to regard the trailing edge reducing mode as a special mode that can be used only when instructed by the user through the operation panel or that is automatically used only in case the recording material contains moisture based on the detection of slippage of the recording material by the method explained in the foregoing embodiments.

In the following there will be explained an embodiment in which the hot offset phenomenon is not important but the trailing edge is to be avoided. The components of the device are basically same as those in the foregoing embodiments, but, in the present embodiment, the power supply control means selects substantially same power supply duty ratios for the two heat-generating resistance members 710, 720 at the start-up stage, and selects a larger power supply duty ratio for the resistance member 720 of the downstream side than that for the resistance member 710 of the upstream side at the fixing stage.

The present embodiment is thus rendered capable of preventing the slippage of the recording material and to more securely prevent the trailing edge phenomenon.

The power supply outputs to the two heat-generating resistance members need not be divided in proportions described in the foregoing embodiment, but can also be selected, for example, as 1:2 or 1:3.

The present invention has been explained by the embodiments thereof, but such embodiments are by no means restrictive and the present invention is subject to any and all modifications within the scope and spirit of the appended claims.

What is claimed is:

1. An image heating apparatus comprising:

a heater;

a film sliding on said heater; and a back-up member for forming a nip with said heater via said film, said back-up member receiving a driving force to drive said film;

wherein a recording material bearing an image thereon is pinched and conveyed in said nip whereby the image on said recording material is heated by the heat supplied from said heater via said film;

said heater includes a first heat-generating member for generating heat by electric power supply thereto, and a second heat-generating member, provided at the downstream side of said first heat-generating member with respect to the moving direction of the recording material, for generating heat by electric power supply thereto; and wherein an amount of heat generation is substantially equivalent for said first and second heat-generating members when there is an absence of the recording material in said nip when electric power is supplied to said first and second heat-generating members, and the amount of heat generation of said first heat-generating member is larger than that of said second heat-generating member when there is a presence of the recording material in said nip.

2. An image heating apparatus according to claim 1, wherein the case of absence of the recording material in said nip corresponds to the start-up stage of said heater.

3. An image heating apparatus according to claim 1, wherein the case of absence of the recording material in said nip corresponds to the interval between the recording materials in the continuous image heating operation.

4. An image heating apparatus according to claim 1, wherein the case of presence of the recording material in said nip corresponds to the heating stage of the image on the recording material.

5. An image heating apparatus according to claim 1, wherein, in case the amount of heat generation is substantially equivalent for said first and second heat-generating members, the center of heat generation of said heater substantially coincides with the center of said nip.

6. An image heating apparatus according to claim 1, further comprising detection means for detecting slippage of the recording material, so that the ratio of the amounts of heat generation of said first and second heat-generating members is controlled, in the absence of the recording material in said nip, based on the result of detection by said detection means.

7. An image heating apparatus according to claim 1, wherein said first and second heat-generating members are mutually independently controllable in electric power supply thereto.

8. An image heating apparatus according to claim 7, wherein the ratio of the amounts of heat generation of said first and second heat-generating members is controlled by the ratio of the power supply duty ratios to said first and second heat-generating members.

9. An image heating apparatus according to claim 1, wherein said heater includes a substrate member extending in a direction perpendicular to the moving direction of said film, and said first and second heat-generating members are provided on said substrate member along the longitudinal direction thereof.

10. An image heating apparatus according to claim 1, wherein said back-up member is a rotatable roller.

11. An image heating apparatus comprising:

a heater;

a film sliding on said heater;

a back-up member for forming a nip with said heater via said film, said back-up member receiving a driving force to drive said film; and wherein a recording material bearing an image thereon is pinched and conveyed in said nip whereby the image on said recording material is heated by the heat supplied from said heater via said film; and said heater includes a first heat-generating member for generating heat by electric power supply thereto, and a second heat-generating member, provided at the downstream side of said first heat-generating member with respect to the moving direction of the recording material, for generating heat by electric power supply thereto; and detection means for detecting whether a recording material is slipping;

wherein a ratio of the amount of heat generation of said first and second heat-generating members differs between a case where it is judged by said detection means that the recording material is slipping and a case where it is judged by said detection means that the recording material is not slipping, and the amount of heat generation is substantially equivalent for said first and second heat-generating members when it is judged by said detection means that the recording material is slipping.

12. An image heating apparatus according to claim 11, wherein the recording material is absent in said nip when the amount of heat generation is substantially equivalent for said first and second heat-generating members.

13. An image heating apparatus according to claim 12, wherein the case of absence of the recording material in said nip corresponds to an interval between the recording materials in the continuous image heating operation.

14. An image heating apparatus according to claim 12, wherein the case of absence of the recording material in said nip corresponds to a post-treatment stage immediately after the end of the image heating operation.

15. An image heating apparatus according to claim 11, wherein the amount of heat generation of said first heat-generating member is larger than that of said second heat-generating member when said detection means judges that the recording material is not slipping.

16. An image heating apparatus according to claim 11, wherein said heater includes a substrate member extending in a direction perpendicular to the moving direction of said film, and said first and second heat-generating members are provided on said substrate member along the longitudinal direction thereof.

17. An image heating apparatus according to claim 11, wherein said back-up member is a rotatable roller.

18. An image heating apparatus comprising:

a heater;

a film sliding on said heater; and a back-up member for forming a nip with said heater via said film, said back-up member receiving a driving force to drive said film;

wherein a recording material bearing an image thereon is pinched and conveyed in said nip whereby the image on said recording material is heated by the heat supplied from said heater via said film;

wherein said heater includes a first heat-generating member for generating heat by electric power supply thereto, and a second heat-generating member, provided at the downstream side of said first heat-generating member with respect to the moving direction of the recording material for generating heat by electric power supply thereto; and wherein an amount of heat generation is substantially equivalent for said first and second heat-generating members when there is an absence of the recording material in said nip and electric power is supplied to said first and second heat-generating members, and the amount of heat generation of said second heat-generating member is larger than that of said first heat-generating member when there is a presence of the recording material in said nip.

19. An image heating apparatus according to claim 18, wherein the occurrence of an absence of the recording material in said nip corresponds to the start-up stage of said heater.

20. An image heating apparatus according to claim 18, wherein the occurrence of an absence of the recording material in said nip corresponds to the interval between the recording materials in the continuous image heating operation.

21. An image heating apparatus according to claim 18, wherein the presence of the recording material in said nip corresponds to the heating stage of the image on the recording material.

22. An image heating apparatus according to claim 18, wherein, when the amount of heat generation is substantially equivalent for said first and second heat-generating members, the center of heat generation of said heater substantially coincides with the center of said nip.

23. An image heating apparatus according to claim 18, further comprising detection means for detecting slippage of the recording material, so that the ratio of the amounts of heat generation of said first and second heat-generating members is controlled, in the absence of the recording material in said nip, based on the result of detection by said detection means.

24. An image heating apparatus according to claim 18, wherein said first and second heat-generating members are mutually independently controllable in electric power supply thereto.

25. An image heating apparatus according to claim 18, wherein the ratio of the amounts of heat generation of said first and second heat-generating members is controlled by the ratio of the power supply duty ratios to said first and second heat-generating members.

26. An image heating apparatus according to claim 18, wherein said heater includes a substrate member extending in a direction perpendicular to the moving direction of said film, and said first and second heat-generating members are provided on said substrate member along the longitudinal direction thereof.

27. An image heating apparatus according to claim 18, wherein said back-up member is a rotatable roller.

28. An image heating apparatus comprising:

a heater;

a film sliding on said heater; and a back-up member for forming a nip with said heater via said film, said back-up member receiving a driving force to drive said film;

wherein a recording material bearing an image thereon is pinched and conveyed in said nip whereby the image on said recording material is heated by the heat supplied from said heater via said film;

wherein said heater includes a first heat-generating member for generating heat by electric power supply thereto, and a second heat-generating member, provided at the downstream side of said first heat-generating member with respect to the moving direction of the recording material, for generating heat by electric power supply thereto; and wherein the amount of heat generation of said first heat-generating member is larger than that of said second heat-generating member when there is an absence of the recording material in said nip, and the amount of heat generation of said second heat-generating member is larger than that of said first heat-generating member when there is a presence of the recording material in said nip.

29. An image heating apparatus according to claim 28, wherein the absence of the recording material in said nip corresponds to the start-up stage of said heater.

30. An image heating apparatus according to claim 28, wherein the absence of the recording material in said nip corresponds to the interval between the recording materials in the continuous image heating operation.

31. An image heating apparatus according to claim 28, wherein the presence of the recording material in said nip corresponds to the heating stage of the image on the recording material.

32. An image heating apparatus according to claim 28, wherein, when the amount of heat generation is substantially equivalent for said first and second heat-generating members, the center of heat generation of said heater substantially coincides with the center of said nip.

33. An image heating apparatus according to claim 28, further comprising detection means for detecting slippage of the recording material, so that the ratio of the amounts of heat generation of said first and second heat-generating members is controlled, in the absence of the recording material in said nip, based on the result of detection by said detection means.

34. An image heating apparatus according to claim 28, wherein said first and second heat-generating members are mutually independently controllable in electric power supply thereto.

35. An image heating apparatus according to claim 28, wherein the ratio of the amounts of heat generation of said first and second heat-generating members is controlled by the ratio of the power supply duty ratios to said first and second heat-generating members.

36. An image heating apparatus according to claim 28, wherein said heater includes substrate member extending in a direction perpendicular to the moving direction of said film, and said first and second heat-generating members are provided on said substrate member along the longitudinal direction thereof.

37. An image heating apparatus according to claim 28, wherein said back-up member is a rotatable roller.

* * * * *

UNITED STATES PATENT AND TRADEMARK OFFICE

CERTIFICATE OF CORRECTION

PATENT NO. : 6,040,558

DATED : March 21, 2000

INVENTOR(S): MICHIHITO YAMAZAKI

It is certified that error appears in the above-identified patent and that said Letters Patent is hereby corrected as shown below:

COLUMN 6:
Line 50, "send" should read --end--.

COLUMN 10:
Line 38, "there by" should read --thereby--.

COLUMN 11:
Line 22, "to," should read --to--.

COLUMN 12:
Line 19, "elevated" should read --elevate--.

Signed and Sealed this

Third Day of April, 2001

*Attest:*

Nicholas P. Godici

NICHOLAS P. GODICI

*Attesting Officer*

*Acting Director of the United States Patent and Trademark Office*